US009183788B2

(12) United States Patent
Zhang et al.

(10) Patent No.: US 9,183,788 B2
(45) Date of Patent: Nov. 10, 2015

(54) BACKLIGHT DRIVING CIRCUIT, LCD DEVICE, AND METHOD FOR DRIVING THE BACKLIGHT DRIVING CIRCUIT

(71) Applicant: SHENZHEN CHINA STAR OPTOELECTRONICS TECHNOLOGY CO., LTD, Shenzhen (CN)

(72) Inventors: Hua Zhang, Shenzhen (CN); Fei Li, Shenzhen (CN)

( * ) Notice: Subject to any disclaimer, the term of this patent is extended or adjusted under 35 U.S.C. 154(b) by 268 days.

(21) Appl. No.: 13/981,335

(22) PCT Filed: Jun. 27, 2013

(86) PCT No.: PCT/CN2013/078153
§ 371 (c)(1),
(2) Date: Jul. 24, 2013

(87) PCT Pub. No.: WO2014/187005
PCT Pub. Date: Nov. 27, 2014

(65) Prior Publication Data

US 2014/0340000 A1 Nov. 20, 2014

(30) Foreign Application Priority Data

May 20, 2013 (CN) ..... 2013 1 0186387

(51) Int. Cl.
*H05B 33/08* (2006.01)
*G09G 3/34* (2006.01)

(52) U.S. Cl.
CPC ..... *G09G 3/3406* (2013.01); *H05B 33/0845* (2013.01); *G09G 2320/062* (2013.01); *G09G 2320/064* (2013.01)

(58) Field of Classification Search
USPC ..... 315/307, 312
See application file for complete search history.

(56) References Cited

U.S. PATENT DOCUMENTS

2006/0175986 A1* 8/2006 Lee et al. ..... 315/312
2013/0088078 A1* 4/2013 Shteynberg et al. ..... 307/31

FOREIGN PATENT DOCUMENTS

CN 101010649 A 8/2007
CN 101668377 A 3/2010
CN 201523469 U 7/2010
CN 102164439 A 8/2011
CN 102982772 A 3/2013

(Continued)

OTHER PUBLICATIONS

He Xiaofeng, the International Searching Authority written comments, Feb. 2014, CN.

*Primary Examiner* — Douglas W Owens
*Assistant Examiner* — Jonathan Cooper

(57) ABSTRACT

A backlight driving circuit includes a constant current driving chip, a power module, and a light emitting diode (LED) lightbar coupled with the power module. The constant current driving chip includes a control module that controls switching frequency of the power module, and an adjusting module that adjusts duty cycle of effective current flowing through the LED lightbar. The control module includes a frequency pin used to set the switching frequency of the power module. An external pulse-width modulation (PWM) dimming signal is sent to the adjusting module of the constant current driving chip. The backlight driving circuit further includes a detection module that detects duty cycle of the PWM dimming signal, and a monitor module coupled with the detection module of the backlight driving circuit.

17 Claims, 5 Drawing Sheets

(56) References Cited

FOREIGN PATENT DOCUMENTS

| | | | | |
|---|---|---|---|---|
| CN | 103069925 | A | | 4/2013 |
| JP | 2012124003 | | * | 6/2012 |
| TW | 201110093 | A1 | | 3/2011 |
| WO | WO2013/007787 | A1 | | 1/2013 |

* cited by examiner

BACKLIGHT DRIVING CIRCUIT, LCD DEVICE, AND METHOD FOR DRIVING THE BACKLIGHT DRIVING CIRCUIT

TECHNICAL FIELD

The present disclosure relates to the field of liquid crystal displays (LCDs), and more particularly to a backlight driving circuit, an LCD device and a method for driving the backlight driving circuit.

BACKGROUND

A liquid crystal display (LCD) device includes an LCD panel and a backlight module. The backlight module includes a light emitting diode (LED) backlight driving circuit. As shown in FIG. 1, the LED backlight driving circuit includes an LED lightbar 30, a power module 10 driving the LED lightbar 30, and a constant current driving chip 20 that controls the power module 10. The constant current driving chip 20 receives an external pulse-width modulation (PWM) dimming signal to control an effective current flowing through the LED lightbar 30, thus, influencing brightness of the LED lightbar 30.

The constant current driving chip 20 outputs a driving signal to a metal-oxide-semiconductor field-effect transistor (MOSFET) of the power module 10. When the MOSFET turns on, an inductor stores energy. When the MOSFET turns off, the inductor releases energy to provide a high voltage for the LED lightbar. An equation of an output voltage is: $V_0$=Vin/(1-D), where D is a duty cycle of a driving waveform. Power loss of the MOSFET is in connection with a frequency of the driving signal and a turn-on time in a unit period. When the frequency of the driving signal is great, a switching loss of the MOSFET is great, but turn-on time in unit period is short, and a conduction loss of the MOSFET is small. When the frequency of the driving signal is small, the switching loss of the MOSFET is small, but turn-on time in unit period is long, and the conduction loss of the MOSFET is great.

SUMMARY

The aim of the present disclosure is to provide a backlight driving circuit, a liquid crystal display (LCD) device, and a method for driving the backlight driving circuit capable of increasing transfer efficiency of a power module.

The aim of the present disclosure is achieved by the following method.

A the backlight driving circuit comprises a constant current driving chip, a power module, a light emitting diode (LED) lightbar coupled with the power module, a detection module that detects duty cycle of a pulse-width modulation (PWM) dimming signal, and a monitor module coupled with the detection module. The constant current driving chip comprises a control module that controls switching frequency of the power module, and an adjusting module that adjusts duty cycle of effective current flowing through the LED lightbar. The control module comprises a frequency pin used to set the switching frequency of the power module. An external PWM dimming signal is sent to the adjusting module of the constant current driving chip. When the duty cycle of the PWM dimming signal is less than a preset threshold, the monitor module outputs a signal to the frequency pin to reduce the switching frequency of the power module.

Furthermore, the detection module comprises a divider resistor and a photoresistor that is adjacent to the LED lightbar. A high level reference voltage is inputted to an end of the photoresistor, and an opposite end of the photoresistor is coupled with a ground terminal of the backlight driving circuit through the divider resistor. A voltage across the divider resistor is fed back to the monitor module. This is a specific circuit of the detection module. It should be understood, when the duty cycle of the PWM dimming signal increases, brightness of the LED lightbars increases. In contrast, when the duty cycle of the PWM dimming signal reduces, brightness of the LED lightbars 30 reduces. The example obtains change of the brightness of the LED lightbars through the photoresistor: when the reference voltage and a resistance value of the divider resistor are constant, and the duty cycle of the PWM dimming signal is great, the average current of the LED lightbars and the brightness of the LED lightbars are great, a resistance value of the photoresistor is small, thus voltage across the divider resistor increases. In contrast, the voltage across the divider resistor reduces. As long as the PWM dimming signal is mapping relation with the voltage across the divider resistor, the monitor module can determine whether the duty cycle of the PWM dimming signal is less than the preset threshold or not according to change of the voltage across the divider resistor. Two resistors are used in the example to allow the backlight driving circuit of the present disclosure to transfer a complicated detection of the duty cycle of the PWM dimming signal to a simple voltage detection, which is simple operation and low cost.

Furthermore, the monitor module comprises a comparator and a first controllable switch. A first resistor and a second resistor are connected in series between the frequency pin and a ground terminal of the backlight driving circuit. The first controllable switch and the second resistor are connected in parallel. A comparison voltage is inputted to an inverting input of the comparator, and a non-inverting input of the comparator is coupled with an end of a divider resistor that is connected with the photoresistor. Frequency of a driving signal of the power module controlled by the constant current driving chip is relative to the resistance value of the resistor connected with the frequency pin. The resistance value of the resistor and the frequency of the driving signal are inversely proportional. The comparison voltage inputted to the inverting input of the comparator is equal to the voltage across the divider resistor corresponding to the preset threshold. When the duty cycle of the PWM dimming signal is less than the preset threshold, the comparator outputs a low level signal, the first controllable switch turns off, and the resistance value of the resistor connected with the frequency pin is equal to a sum of the resistance value of the first resistor and the resistance value of the second resistor. The frequency of the driving signal output by the control module reduces, thus reducing the switching loss of the power module. When the duty cycle of the PWM dimming signal exceeds the preset threshold, the comparator outputs a high level signal, the first controllable switch turns on, and the resistance value of the resistor connected with the frequency pin is equal to the resistance value of the first resistor. The frequency of the driving signal output by the control module increases, thus reducing the switching loss of the power module.

Furthermore, a photoresistor is connected in series between the frequency pin and a ground terminal of the backlight driving circuit. The photoresistor is arranged on a position directly irradiated by the LED lightbars. It should be understood, when the duty cycle of the PWM dimming signal increases, brightness of the LED lightbars increases. In contrast, when the duty cycle of the PWM dimming signal reduces, brightness of the LED lightbars reduces. The example obtains change of the brightness of the LED lightbars through the photoresistor: when the reference voltage and a resistance value of the divider resistor are constant, and the duty cycle of the PWM dimming signal is great, the average current of the LED lightbars and the brightness of the LED lightbars are great, and a resistance value of the photoresistor is small. In contrast, the resistance value of the photoresistor increases. The frequency of driving signal of the power module controlled by the constant current driving chip is relative to the resistance value of the resistor connected with the frequency pin. The resistance value of the resistor and frequency of the driving signal are inversely proportional.

Thus, as long as the photoresistor is arranged on a position directly irradiated by the LED lightbars, the resistance value of the photoresistor is fed back to the frequency pin. When the brightness of the LED lightbars reduces, the output frequency of the control module gradually reduces, thereby reducing the switching loss at a low load and increasing the transfer efficiency of the backlight driving circuit. The example only uses the photoresistor to simultaneously achieve function of the monitor module and the detection module of the backlight driving circuit, which reduces the cost, achieves continuously adjustment of the frequency of the driving signal of the control module, and improves control precision.

Furthermore, the detection module comprises a filtering resistor and a filtering capacitor. The monitor module comprises a comparator and a first controllable switch. A first resistor and a second resistor are connected in series between the frequency pin and the ground terminal of the backlight driving circuit. The controllable switch and the second resistor are connected in parallel. A comparison voltage is inputted to an inverting input of the comparator, and the PWM dimming signal is sent to the non-inverting input of the comparator through the filtering resistor. The filtering capacitor is connected in series between the non-inverting input of the comparator and the ground terminal of the backlight driving circuit. The detection module of the example uses a resistance-capacity (RC) filter to transfer a fluctuating PWM dimming signal having a high frequency to a stable voltage signal, and transfer the PWM dimming signal having a rectangular waveform to a stable voltage signal of direct current, the different duty cycles of the PWM dimming signal correspond to the different voltage signals of direct current. Thus, equivalent voltage of the PWM dimming signal corresponding to the preset threshold may be compared with the voltage of the PWM dimming signal through filtering, thus determining whether the duty cycle of the PWM dimming signal exceeds the preset threshold or not. The example only transfers comparing the duty cycles of the PWM dimming signal to comparing the voltages, which reduces difficulty of the technology, improves progress of the developing, and research and development cost.

Furthermore, the detection module comprises a divider resistor and a photoresistor that is adjacent to the LED lightbars. A high level reference voltage is inputted to an end of the photoresistor. An opposite end of the photoresistor is coupled with the ground terminal of the backlight driving circuit. The monitor module comprises a comparator and a first controllable switch. A first resistor and a second resistor are connected in series between the frequency pin and the ground terminal of the backlight driving circuit. The first controllable switch and the second resistor are connected in parallel. A comparison voltage is inputted to a non-inverting input of the comparator, and an inverting input of the comparator is coupled with an end of a divider resistor that is connected with the photoresistor. This is specific circuit of the detection module and the monitor module. It should be understood, when the duty cycle of the PWM dimming signal increases, brightness of the LED lightbars increases. In contrast, when the duty cycle of the PWM dimming signal reduces, brightness of the LED lightbars 30 reduces. The example obtains change of the brightness of the LED lightbars through the photoresistor: when the reference voltage and the resistance value of the divider resistor are constant, the duty cycle of the PWM dimming signal is great, and the average current of the LED lightbars and the brightness of the LED lightbars are great, and a resistance value of the photoresistor is small. In contrast, the resistance value of the photoresistor increases. As long as the PWM dimming signal is mapping relation with the voltage across the divider resistor, the monitor module can determine whether the duty cycle of the PWM dimming signal is less than the preset threshold or not according to change of the voltage across the divider resistor. Two resistors are used in the example to allow the backlight driving circuit of the present disclosure to transfer the complicated detection of the duty cycle of the PWM dimming signal to the simple voltage detection, which is simple operation and low cost.

Frequency of a driving signal of the power module controlled by the constant current driving chip is relative to the resistance value of the resistor connected with the frequency pin. The resistance value of the resistor and the frequency of the driving signal are inversely proportional. The comparison voltage inputted to the non-inverting input of the comparator is equal to the voltage across the divider resistor corresponding to the preset threshold. When the duty cycle of the PWM dimming signal is less than the preset threshold, the comparator outputs a low level signal, the first controllable switch turns off, and the resistance value of the resistor connected with the frequency pin is equal to the sum of the resistance value of the first resistor and the resistance value of the second resistor. The frequency of the driving signal output by the control module reduces, thus reducing the switching loss of the power module. When the duty cycle of the PWM dimming signal exceeds the preset threshold, the comparator outputs a high level signal, the first controllable switch turns on, and the resistance value of the resistor connected with the frequency pin is equal to the resistance value of the first resistor. The frequency of the driving signal output by the control module increases, thus reducing the switching loss of the power module.

Furthermore, the power module comprises an inductor, a diode, an adjusting voltage controllable switch, and a capacitor. An external input voltage is inputted to an end of the inductor; an opposite end of the inductor is coupled with an anode of the diode, and is coupled with a ground terminal of the backlight driving circuit through the adjusting voltage controllable switch. A cathode of the diode is coupled with an anode of the LED lightbar, and is coupled with the ground terminal of the backlight driving circuit through the capacitor. The adjusting voltage controllable switch is coupled with the control module. This is a boosted circuit of the power module.

Furthermore, the adjusting module comprises an adjusting dimming controllable switch. An input end of the adjusting dimming controllable switch is coupled with a cathode of the LED lightbar. An output end of the adjusting dimming controllable switch is coupled with a ground terminal of the backlight driving circuit through a current-limiting resistor. The PWM dimming signal is sent to a control end of the controllable switch. This is specific circuit of the adjusting module.

Furthermore, the power module comprises an inductor, a diode, an adjusting voltage controllable switch, and a capacitor. An external input voltage is inputted to an end of the inductor. An opposite end of the inductor is coupled with an anode of the diode, and is coupled with a ground terminal of the backlight driving circuit through the adjusting voltage controllable switch. A cathode of the diode is coupled with an anode of the LED lightbar, and is coupled with the ground terminal of the backlight driving circuit through the capacitor. The adjusting voltage controllable switch is coupled with the control module.

The adjusting module comprises an adjusting dimming controllable switch. An input end of the adjusting dimming controllable switch is coupled with a cathode of the LED lightbar. An output end of the adjusting dimming controllable switch is coupled with a ground terminal of the backlight driving circuit through a current-limiting resistor. The PWM dimming signal is sent to a control end of the controllable switch.

The detection module comprises a divider resistor and a photoresistor that is adjacent to the LED lightbar. A high level reference voltage is inputted to an end of the photoresistor. An opposite end of the photoresistor is coupled with the ground terminal of the backlight driving circuit through the divider resistor.

The monitor module comprises a comparator and a first controllable switch. A first resistor and a second resistor are connected in series between the frequency pin and the ground terminal of the backlight driving circuit. The first controllable switch and the second resistor are connected in parallel. A comparison voltage is inputted to an inverting input of the comparator, and a non-inverting input of the comparator is coupled with an end of a divider resistor that is connected with the photoresistor.

A light crystal display (LCD) device comprises a backlight driving circuit of the present disclosure.

A method for driving the backlight driving circuit. The backlight driving circuit comprises the power module controlled by switching frequency, the LED lightbar coupled with the power module, and the adjusting module that adjusts the duty cycle of effective current flowing through the LED lightbars. The PWM dimming signal is sent to the adjusting module, the method comprises:

A: setting the preset threshold of the duty cycle of the PWM dimming signal; and B: monitoring the duty cycle of the PWM dimming signal in real time. It the duty cycle of the PWM dimming signal is less than the preset threshold, the switching frequency of the power module is reduced; in contrast, the present status is not changed.

It should be understood, when the backlight driving circuit is at a dimming state, current of the LED lightbar changes in accordance with change of the PWM dimming signal. When an average value of the current of the LED lightbar reduces, output power reduces and current of the inductor also reduces; at that time, main loss of the power module is due to switching loss, namely due to the driving frequency of the control module of the constant current driving chip. Thus, the present disclosure uses the monitor module and the detection module of the backlight driving circuit, and sets a preset threshold of the duty cycle of the PWM dimming signal. The detection module of the backlight driving circuit detects the duty cycle of the PWM dimming signal in real time. When the duty cycle of the PWM dimming signal is less than the preset threshold, the switching frequency of the power module is reduced, in contrast, the present status is not change. Thus, when the average value of the current of the LED lightbar reduces, the switching frequency of the power module is reduced, thereby reducing the switching loss of the power module reduces and improving transfer efficiency of the power module.

DETAILED DESCRIPTION

The present disclosure provides a liquid crystal display (LCD) device comprising an LCD panel and a backlight module. The backlight module comprises a backlight driving circuit. The backlight driving circuit comprises a constant current driving chip, a power module, and a light emitting diode (LED) lightbar coupled with the power module. The constant current driving chip comprises a control module that controls switching frequency of the power module, and an adjusting module that adjusts a duty cycle of an effective current flowing through the LED lightbar. The control module comprises a frequency pin used to set the switching frequency of the power module. The adjusting module of the constant current driving chip is coupled with an external pulse-width modulation (PWM) dimming signal. The backlight driving circuit further comprises a detection module that detects a duty cycle of the PWM dimming signal, and a monitor module coupled with the detection module of the backlight driving circuit. When the duty cycle of the PWM dimming signal is less than a preset threshold, the monitor module outputs a signal to the frequency pin to reduce the switching frequency of the power module.

It should be understood, when the backlight driving circuit is in a dimming state, current of the LED lightbar changes in accordance with change of the PWM dimming signal. When an average value of the current of the LED lightbar reduces, output power reduces and current of the inductor also reduces; at that time, main loss of the power module is due to switching loss, namely due to the driving frequency of the control module of the constant current driving chip. Thus, the present disclosure uses the monitor module and the detection module of the backlight driving circuit, and sets a preset threshold of the duty cycle of the PWM dimming signal. The detection module of the backlight driving circuit detects the duty cycle of the PWM dimming signal in real time. When the duty cycle of the PWM dimming signal is less than the preset threshold, the switching frequency of the power module is reduced, in contrast, the present status is not changed. Thus, when the average value of the current of the LED lightbar reduces, the switching frequency of the power module is reduced, thereby reducing the switching loss of the power module and improving transfer efficiency of the power module.

The present disclosure is further described in detail in accordance with the figures and the exemplary examples.

Example 1

Figure 1:
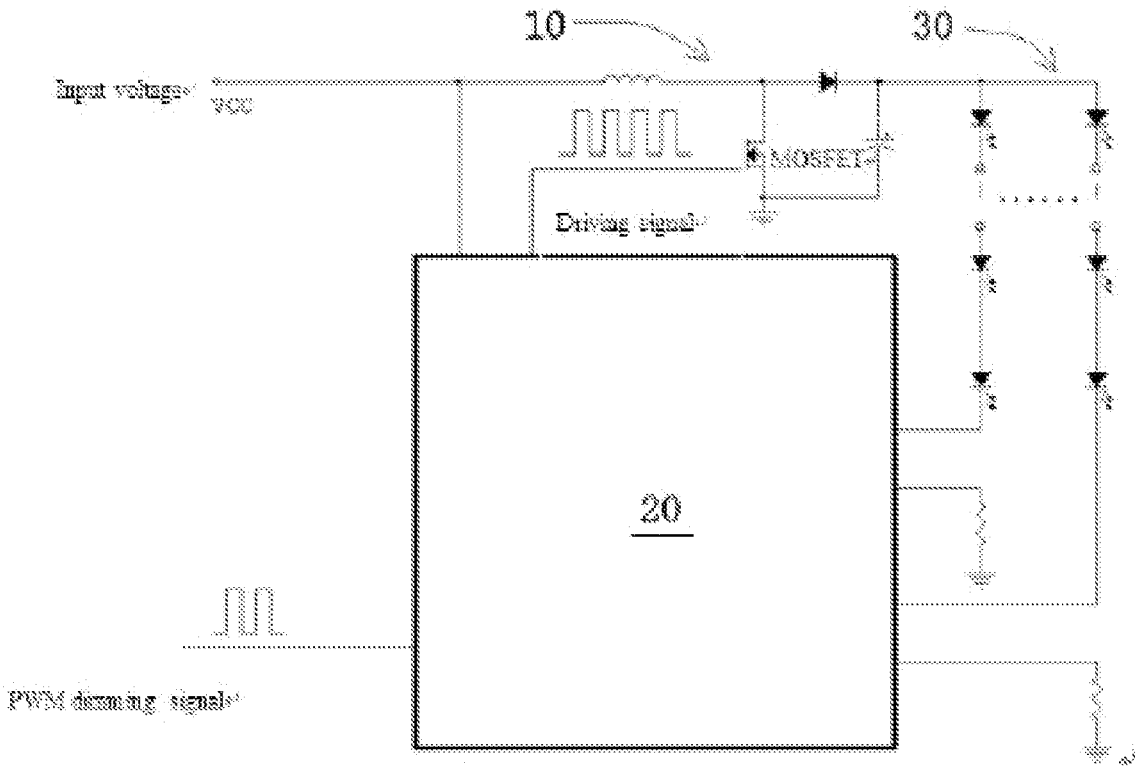
FIG. 1 (PRIOR ART)
FIG. 1 is a schematic diagram of a typical backlight driving circuit.
Figure 2:
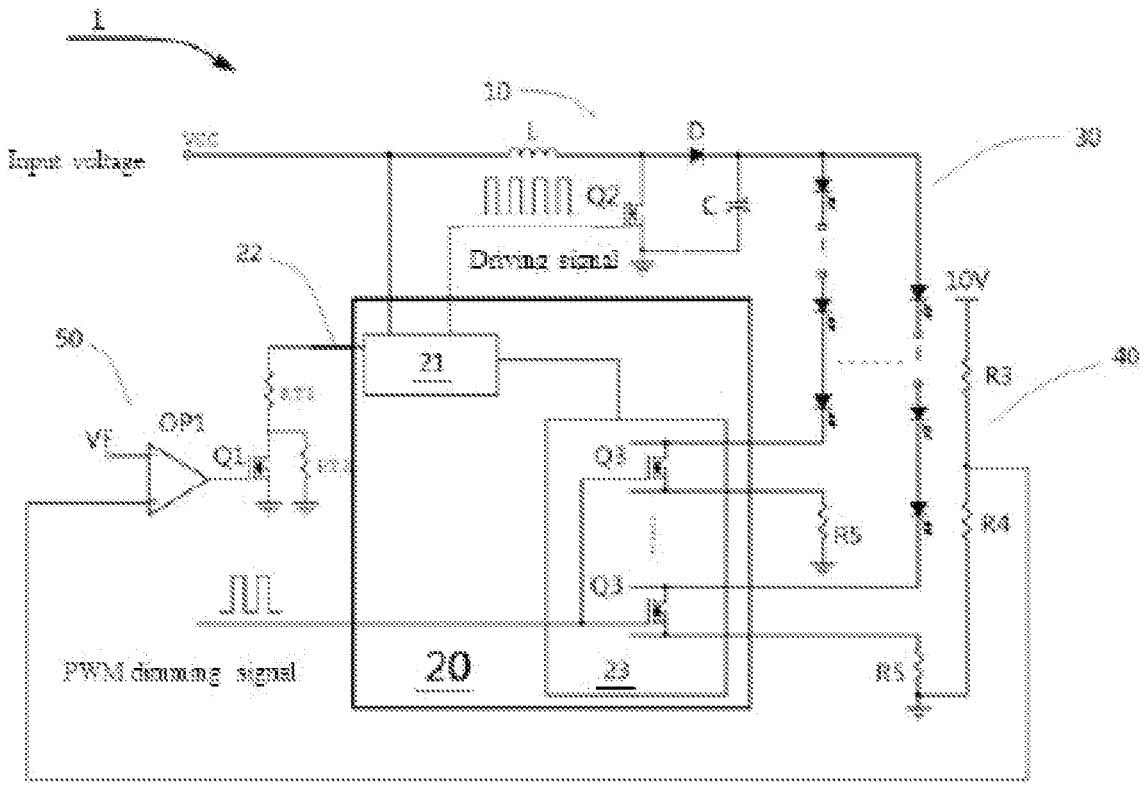
FIG. 2 is a schematic diagram of a backlight driving circuit of a first example of the present disclosure.

As shown in FIG. 2, the backlight driving circuit 1 comprises a constant current driving chip 20, a power module 10, and a light emitting diode (LED) lightbar 30 coupled with the power module 10. The constant current driving chip 20 comprises a control module 21 that controls the switching frequency of the power module 10, and an adjusting module 23 that adjusts the duty cycle of an effective current flowing through the LED lightbar 30. The control module 21 comprises the frequency pin 22 used to set the switching frequency of the power module 10. The external pulse-width modulation (PWM) dimming signal is sent to the adjusting module 23 of the constant current driving chip. The backlight driving circuit 1 further comprises the detection module 40 that detects the duty cycle of the PWM dimming signal, and the monitor module 50 coupled with the detection module 40 of the backlight driving circuit. When the duty cycle of the PWM dimming signal is less than the preset threshold, the monitor module 50 outputs the signal to the frequency pin 22 to reduce the switching frequency of the power module.

The power module 10 comprises an inductor L, a diode D, an adjusting voltage controllable switch Q2, and a capacitor C. An external input voltage is inputted to an end of the inductor L. An opposite end of the inductor L is coupled with an anode of the diode D, and is coupled with a ground terminal of the backlight driving circuit 1 through the adjusting voltage controllable switch Q2. A cathode of the diode D is coupled with an anode of the LED lightbar 30, and is coupled with the ground terminal of the backlight driving circuit 1 through the capacitor C. The adjusting voltage controllable switch Q2 is coupled with the control module 21. The adjusting module 23 of the constant current driving chip comprises an adjusting dimming controllable switch Q3. An input end of the adjusting dimming controllable switch Q3 is coupled with a cathode of the LED lightbar 30. An output end of the adjusting dimming controllable switch Q3 is coupled with the ground terminal of the backlight driving circuit 1 through a current-limiting resistor R5. The PWM dimming signal is sent to a control end of the adjusting dimming controllable switch Q3.

The detection module 40 of the backlight driving circuit comprises a divider resistor R4 and a photoresistor R3 which is adjacent to the LED lightbar 30. A high level reference voltage (logic 1) is inputted to an end of the photoresistor R3, and an opposite end of the photoresistor R3 is coupled with the ground terminal of the backlight driving circuit through the divider resistor R4. A high level stable voltage in the backlight driving circuit may be used as the reference voltage, such as a voltage of 10V, 12V, or 5V.

The monitor module 50 comprises a comparator OP1 and a first controllable switch Q1. A first resistor RT1 and a second resistor RT2 are connected in series between the frequency pin 22 and the ground terminal of the backlight driving circuit. The first controllable switch Q1 and the second resistor RT2 are connected in parallel. A comparison voltage VF is inputted to an inverting input of the comparator OP1, and a non-inverting input of the comparator OP1 is coupled with an end of the divider resistor R4 which is connected with the photoresistor R3.

It should be understood, when the duty cycle of the PWM dimming signal increases, brightness of the LED lightbars 30 increases. In contrast, when the duty cycle of the PWM dimming signal reduces, brightness of the LED lightbars 30 reduces. The example obtains change of the brightness of the LED lightbars 30 through the photoresistor R3: when the reference voltage and a resistance value of the divider resistor R4 are constant, and the duty cycle of the PWM dimming signal is great, the average current of the LED lightbars 30 and the brightness of the LED lightbars 30 are great, and a resistance value of the photoresistor R3 is small, thus voltage across the divider resistor R4 increases. In contrast, the voltage across the divider resistor R4 reduces. As long as the PWM dimming signal is mapping relation with the voltage across the divider resistor R4, the monitor module 50 can determine whether the duty cycle of the PWM dimming signal is less than the preset threshold or not according to change of the voltage across the divider resistor R4. Two resistors are used in the example to allow the backlight driving circuit of the present disclosure to transfer a complicated detection of the duty cycle of the PWM dimming signal to a simple voltage detection, which is simple operation and low cost.

Frequency of a driving signal of the power module 10 controlled by the constant current driving chip 20 is relative to a resistance value of the resistor connected with the frequency pin 22. The resistance value of the resistor and the frequency of the driving signal are inversely proportional. The comparison voltage VF inputted to the inverting input of the comparator OP1 is equal to the voltage across the divider resistor R4 corresponding to the preset threshold. When the duty cycle of the PWM dimming signal is less than the preset threshold, the comparator OP1 outputs a low level signal (logic 0), the first controllable switch Q1 turns off, and the resistance value of the resistor connected with the frequency pin 22 is equal to a sum of the resistance value of the first resistor RT1 and the resistance value of the second resistor RT2. The frequency of the driving signal output by the control module 21 reduces, thus reducing the switching loss of the power module 10. When the duty cycle of the PWM dimming signal exceeds the preset threshold, the comparator OP1 outputs a high level signal, the first controllable switch Q1 turns on, and the resistance value of the resistor connected with the frequency pin 22 is equal to the resistance value of the first resistor RT1. The frequency of the driving signal output by the control module 21 increases, thus reducing the switching loss of the power module 10.

Example 2

Figure 3:
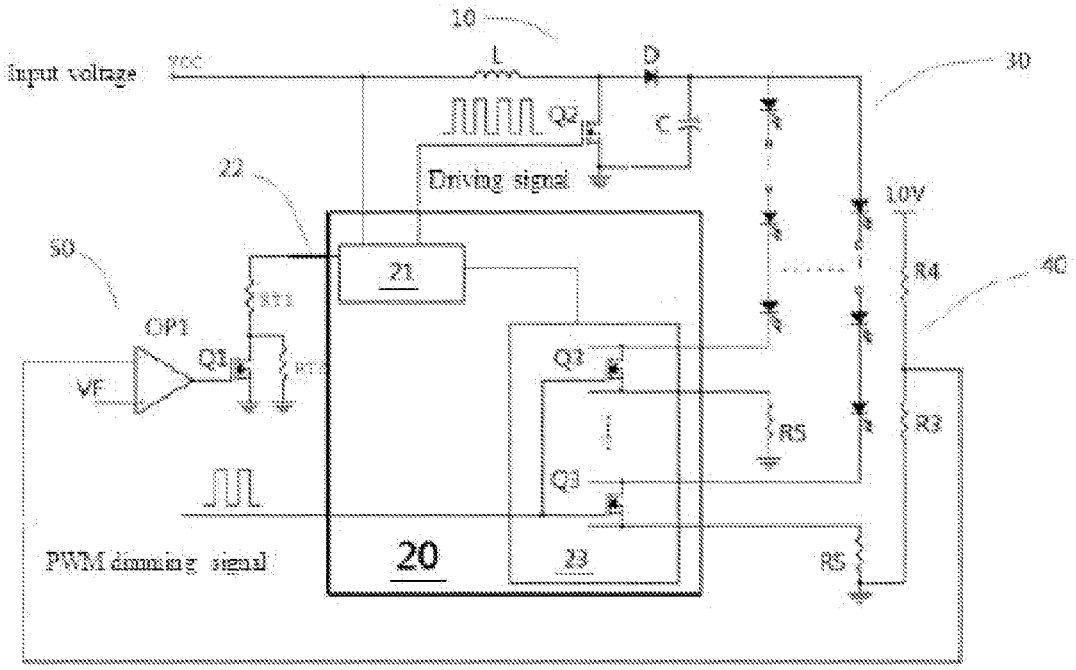
FIG. 3 is a schematic diagram of a backlight driving circuit of a second example of the present disclosure.

As shown in FIG. 3, the backlight driving circuit 1 comprises the constant current driving chip 20, the power module 10, and the light emitting diode (LED) lightbar 30 coupled with the power module 10. The constant current driving chip 20 comprises the control module 21 that controls the switching frequency of the power module 10, and the adjusting module 23 that adjusts the duty cycle of an effective current flowing through the LED lightbar 30. The control module 21 comprises the frequency pin 22 that sets the switching frequency of the power module 10. The external pulse-width modulation (PWM) dimming signal is sent to the adjusting module 23 of the constant current driving chip. The backlight driving circuit 1 further comprises the detection module 40 that detects the duty cycle of the PWM dimming signal, and the monitor module 50 coupled with the detection module 40 of the backlight driving circuit.

When the duty cycle of the PWM dimming signal is less than the preset threshold, the monitor module 50 outputs the signal to the frequency pin 22 to reduce the switching frequency of the power module.

The power module 10 comprises the inductor L, the diode D, the adjusting voltage controllable switch Q2, and the capacitor C. The external input voltage is inputted to one end of the inductor L. The opposite end of the inductor L is coupled with the anode of the diode D, and is coupled with the ground terminal of the backlight driving circuit 1 through the adjusting voltage controllable switch Q2. The cathode of the diode D is coupled with the anode of the LED lightbar 30, and is coupled with the ground terminal of the backlight driving circuit 1 through the capacitor C. The adjusting voltage controllable switch Q2 is coupled with the control module 21. The adjusting module 23 of the constant current driving chip comprises the adjusting dimming controllable switch Q3. The input end of the adjusting dimming controllable switch Q3 is coupled with the cathode of the LED lightbar 30. The output end of the adjusting dimming controllable switch Q3 is coupled with the ground terminal of the backlight driving circuit 1 through the current-limiting resistor R5. The PWM dimming signal is sent to the control end of the adjusting dimming controllable switch Q3.

The detection module 40 of the backlight driving circuit comprises the divider resistor R4 and the photoresistor R3 which is adjacent to the LED lightbars 30. The high level reference voltage is inputted to one end of the photoresistor R3. The opposite end of the photoresistor R3 is coupled with the ground terminal of the backlight driving circuit through the divider resistor R4. A stable high level voltage in the backlight driving circuit may be used as the reference voltage, such as a voltage of 10V, 12V, or 5V.

The monitor module 50 comprises the comparator OP1 and the first controllable switch Q1. The first resistor RT1 and the second resistor RT2 are connected in series between the frequency pin 22 and the ground terminal of the backlight driving circuit. The first controllable switch Q1 and the second resistor RT2 are connected in parallel. The comparison voltage VF is inputted to the non-inverting input of the comparator OP1, and the inverting input of the comparator OP1 is coupled with the end of the divider resistor R4 which is connected with the photoresistor R3.

It should be understood, when the duty cycle of the PWM dimming signal increases, brightness of the LED lightbars 30 increases. In contrast, when the duty cycle of the PWM dimming signal reduces, brightness of the LED lightbars 30 reduces. The example obtains change of the brightness of the LED lightbars 30 through the photoresistor R3: when the reference voltage and the resistance value of the divider resistor R4 are constant, and the duty cycle of the PWM dimming signal is great, the average current of the LED lightbars 30 and the brightness of the LED lightbars 30 are great, and a resistance value of the photoresistor R3 is small. In contrast, the resistance value of the photoresistor R3 increases. As long as the PWM dimming signal is mapping relation with the voltage across the divider resistor R4, the monitor module 50 can determine whether the duty cycle of the PWM dimming signal is less than the preset threshold or not according to change of the voltage across the divider resistor R4. Two resistors are used in the example to allow the backlight driving circuit of the present disclosure to transfer the complicated detection of the duty cycle of the PWM dimming signal to the simple voltage detection, which is simple operation and low cost.

Frequency of a driving signal of the power module 10 controlled by the constant current driving chip 20 is relative to the resistance value of the resistor connected with the frequency pin 22. The resistance value of the resistor and the frequency of the driving signal are inversely proportional. The comparison voltage VF inputted to the non-inverting input of the comparator OP1 is equal to the voltage across the divider resistor R4 corresponding to the preset threshold. When the duty cycle of the PWM dimming signal is less than the preset threshold, the comparator OP1 outputs the low level signal, the first controllable switch Q1 turns off, and the resistance value of the resistor connected with the frequency pin 22 is equal to the sum of the resistance value of the first resistor RT1 and the resistance value of the second resistor RT2. The frequency of the driving signal output by the control module 21 reduces, thus reducing the switching loss of the power module 10. When the duty cycle of the PWM dimming signal exceeds the preset threshold, the comparator OP1 outputs the high level signal, the first controllable switch Q1 turns on, and the resistance value of the resistor connected with the frequency pin 22 is equal to the resistance value of the first resistor RT1. The frequency of the driving signal output by the control module 21 increases, thus reducing the switching loss of the power module 10.

Example 3

Figure 4:
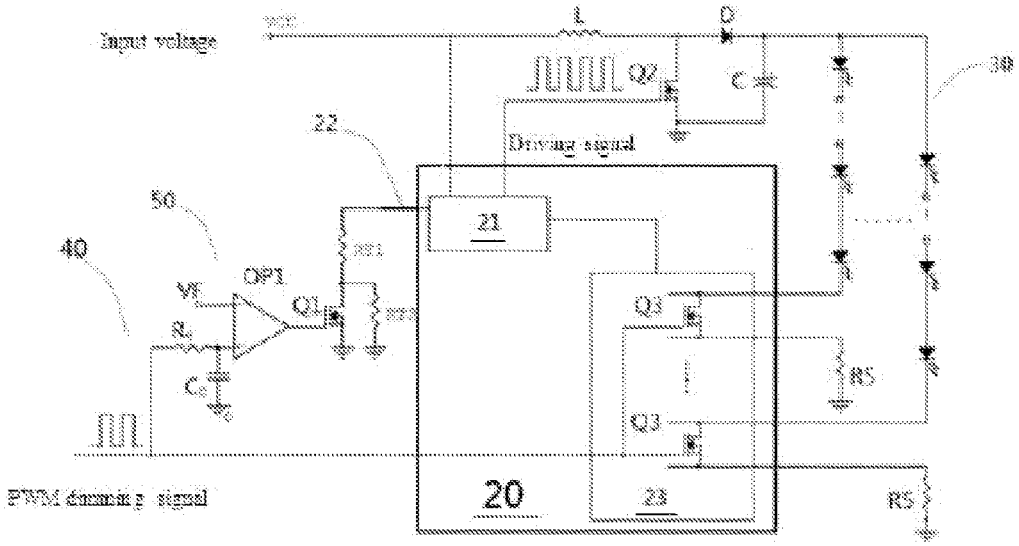
FIG. 4 is a schematic diagram of a backlight driving circuit of a third example of the present disclosure.

As shown in FIG. 4, the detection module 40 of the backlight driving circuit of the example comprises a filtering resistor $R_0$ and a filtering capacitor $C_0$. The monitor module 50 comprises the comparator OP1 and the first controllable switch Q1. The first resistor RT1 and the second resistor RT2 are connected in series between the frequency pin 22 and the ground terminal of the backlight driving circuit. The first controllable switch Q1 and the second resistor RT2 are connected in parallel. The comparison voltage VF is inputted to the inverting input of the comparator OP1, and the PWM dimming signal is sent to the non-inverting input of the comparator OP1 through the filtering resistor $R_0$. The filtering capacitor $C_0$ is connected in series between the non-inverting input of the comparator OP1 and the ground terminal of the backlight driving circuit.

The detection module 40 of the backlight driving circuit of the example uses a resistance-capacity (RC) filter to transfer a fluctuating PWM dimming signal having a high frequency to a stable voltage signal, and transfer the PWM dimming signal having a rectangular waveform to a stable voltage signal of direct current, where the different duty cycles of the PWM dimming signal correspond to the different voltage signals of direct current. Thus, equivalent voltage of the PWM dimming signal corresponding to the preset threshold may be compared with the voltage of the PWM dimming signal through filtering, thus determining whether the duty cycle of the PWM dimming signal exceeds the preset threshold or not. The example only need two resistors to transfer comparing the duty cycles of the PWM dimming signal to comparing the voltages, which reduces difficulty of the technology, improves progress of the developing, and research and development cost.

Example 4

Figure 5:
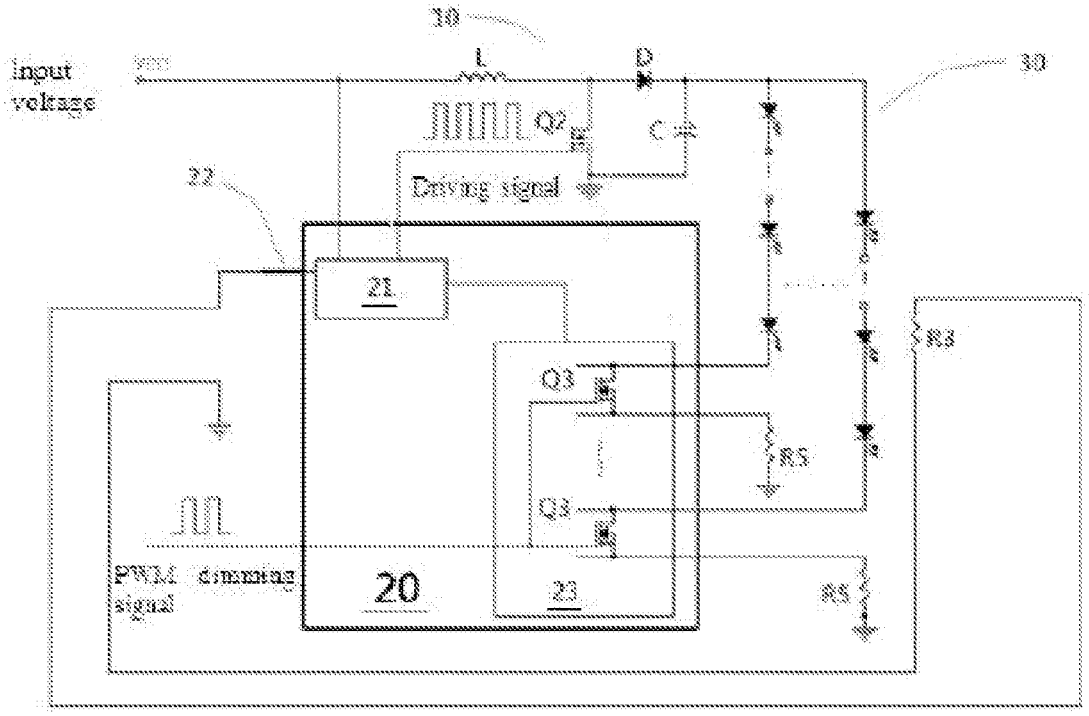
FIG. 5 is a schematic diagram of a backlight driving circuit of a fourth example of the present disclosure.

As shown in FIG. 5, the photoresistor R3 is connected in series between the frequency pin 22 of the constant current driving chip 20 and the ground terminal of the backlight driving circuit. The photoresistor R3 is arranged on a position directly irradiated by the LED lightbars. It should be understood, when the duty cycle of the PWM dimming signal increases, brightness of the LED lightbars 30 increases. In contrast, when the duty cycle of the PWM dimming signal reduces, brightness of the LED lightbars 30 reduces. The example obtains change of the brightness of the LED lightbars 30 through the photoresistor R3: when the reference voltage and the resistance value of the divider resistor R4 are constant, and the duty cycle of the PWM dimming signal is great, the average current of the LED lightbars 30 and the brightness of the LED lightbars 30 are great, and the resistance value of the photoresistor R3 is small. In contrast, the resistance value of the photoresistor R3 increases. The frequency of driving signal of the power module 10 controlled by the constant current driving chip 20 is relative to the resistance value of the resistor connected with the frequency pin 22. The resistance value of the resistor and frequency of the driving signal are inversely proportional.

Thus, as long as the photoresistor R3 is arranged on the position directly irradiated by the LED lightbars, the resistance value of the photoresistor R3 is fed back to the frequency pin 22. When brightness of the LED lightbars reduces, the output frequency of the control module gradually reduces, thereby reducing the switching loss at a low load and increasing the transfer efficiency of the backlight driving circuit. The example only uses the photoresistor R3 to simultaneously achieve function of the monitor module and the detection module of the backlight driving circuit, which reduces the cost, achieves continuously adjustment of the frequency of the driving signal of the control module, and improves control precision.

Example 5

Figure 6:
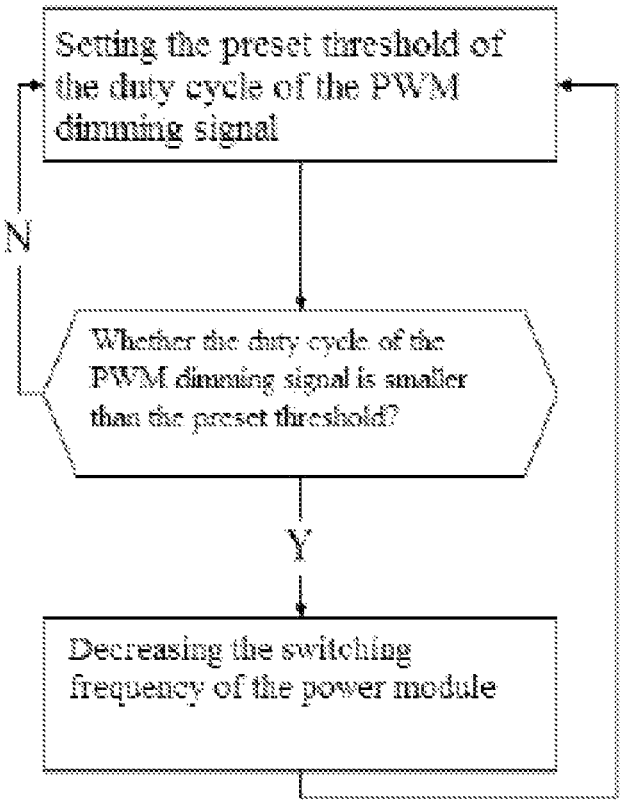
FIG. 6 is a schematic diagram of a backlight driving circuit of a fifth example of the present disclosure.

As shown in FIG. 6, the present disclosure provides a method for driving the backlight driving circuit. The backlight driving circuit comprises the power module controlled by the switching frequency, the LED lightbar 30 coupled with the power module, and the adjusting module that adjusts the duty cycle of an effective current flowing through the LED lightbar 30. The PWM dimming signal is sent to the adjusting module. The method comprises:

A: setting the preset threshold of the duty cycle of the PWM dimming signal; and B: monitoring the duty cycle of the PWM dimming signal in real time. It the duty cycle of the PWM dimming signal is less than the preset threshold, the switching frequency of the power module is reduced; in contrast, the present status is not changed.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A backlight driving circuit, comprising:

a constant current driving chip;

a power module;

a light emitting diode (LED) lightbar coupled with the power module;

a detection module that detects duty cycle of a pulse-width modulation (PWM) dimming signal; and a monitor module coupled with the detection module;

wherein the constant current driving chip comprises a control module that controls switching frequency of the power module, and an adjusting module that adjusts a duty cycle of an effective current flowing through the LED lightbar;

wherein the control module comprises a frequency pin used to set the switching frequency of the power module; an external PWM dimming signal is sent to the adjusting module of the constant current driving chip;

when the duty cycle of the PWM dimming signal is less than a preset threshold, the monitor module outputs a signal to the frequency pin to reduce the switching frequency of the power module, wherein a photoresistor is connected in series between the frequency pin and a ground terminal of the backlight driving circuit; the photoresistor is arranged on a position directly irradiated by the LED lightbar.

2. The backlight driving circuit of claim 1, wherein the monitor module comprises a comparator and a first controllable switch; a first resistor and a second resistor are connected in series between the frequency pin and a ground terminal of the backlight driving circuit; the first controllable switch and the second resistor are connected in parallel; a comparison voltage is inputted to an inverting input of the comparator, and a non-inverting input of the comparator is coupled with a divider resistor and is connected with the detection module.

3. The backlight driving circuit of claim 1, wherein the detection module comprises a divider resistor and a photoresistor that is adjacent to the LED lightbar; a high level reference voltage is inputted to an end of the photoresistor; an opposite end of the photoresistor is coupled with a ground terminal of the backlight driving circuit through the divider resistor; a voltage across the divider resistor is fed back to the monitor module.

4. The backlight driving circuit of claim 3, wherein the monitor module comprises a comparator and a first controllable switch; a first resistor and a second resistor are connected in series between the frequency pin and the ground terminal of the backlight driving circuit; the first controllable switch and the second resistor are connected in parallel; a comparison voltage is inputted to an inverting input of the comparator, and a non-inverting input of the comparator is coupled with a divider resistor and is connected with the detection module.

5. The backlight driving circuit of claim 1, wherein the detection module comprises a filtering resistor and a filtering capacitor, the monitor module comprises a comparator and a first controllable switch; a first resistor and a second resistor are connected in series between the frequency pin and a ground terminal of the backlight driving circuit; the controllable switch and the second resistor are connected in parallel;

wherein a comparison voltage is inputted to an inverting input of the comparator, and the PWM dimming signal is sent to the non-inverting input of the comparator through the filtering resistor, the filtering capacitor is connected in series between the non-inverting input of the comparator and the ground terminal of the backlight driving circuit.

6. The backlight driving circuit of claim 1, wherein the power module comprises an inductor, a diode, an adjusting voltage controllable switch, and a capacitor; an external input voltage is sent to an end of the inductor; an opposite end of the inductor is coupled with an anode of the diode, and is coupled with a ground terminal of the backlight driving circuit through the adjusting voltage controllable switch; a cathode of the diode is coupled with an anode of the LED lightbar, and is coupled with the ground terminal of the backlight driving circuit through the capacitor; the adjusting voltage controllable switch is coupled with the control module.

7. The backlight driving circuit of claim 1, wherein the adjusting module comprises an adjusting dimming controllable switch; an input end of the adjusting dimming controllable switch is coupled with a cathode of the LED lightbar; an output end of the adjusting dimming controllable switch is coupled with a ground terminal of the backlight driving circuit through a current-limiting resistor; the PWM dimming signal is sent to a control end of the controllable switch.

8. The backlight driving circuit of claim 1, wherein the power module comprises an inductor, a diode, an adjusting voltage controllable switch, and a capacitor; an external input voltage is inputted to an end of the inductor; an opposite end of the inductor is coupled with an anode of the diode, and is coupled with a ground terminal of the backlight driving circuit through the adjusting voltage controllable switch; a cathode of the diode is coupled with an anode of the LED lightbar, and is coupled with the ground terminal of the backlight driving circuit through the capacitor; the adjusting voltage controllable switch is coupled with the control module;

wherein the adjusting module comprises an adjusting dimming, controllable switch; an input end of the adjusting dimming controllable switch is coupled with a cathode of the LED lightbar; an output end of the adjusting dimming controllable switch is coupled with a ground terminal of the backlight driving circuit through a current-limiting resistor; the PWM dimming signal is sent to a control end of the controllable switch;

wherein the detection module comprises a divider resistor and a photoresistor that is adjacent to the LED lightbar; a high level reference voltage is inputted to an end of the photoresistor; an opposite end of the photoresistor is coupled with the ground terminal of the backlight driving circuit through the divider resistor;

wherein the monitor module comprises a comparator and a first controllable switch; a first resistor and a second resistor are connected in series between the frequency pin and the ground terminal of the backlight driving circuit; the first controllable switch and the second resistor are connected in parallel; a comparison voltage is inputted to an inverting input of the comparator, and a non-inverting input of the comparator is coupled with an end of a divider resistor that is connected with the photoresistor.

9. A light crystal display (LCD) device, comprising:

a backlight driving circuit;

wherein the backlight driving circuit comprises a constant current driving chip, a power module, a light emitting diode (LED) lightbar coupled with the power module, a detection module that detects duty cycle of a pulse-width modulation (PWM) dimming signal, and a monitor module coupled with the detection module;

wherein the constant current driving chip comprises a control module that controls switching frequency of the power module, and an adjusting module that adjusts duty cycle of effective current flowing through the LED lightbar;

wherein the control module comprises a frequency pin used to set the switching frequency of the power module; an external PWM dimming signal is sent to the adjusting module of the constant current driving chip;

when the duty cycle of the PWM dimming signal is less than a preset threshold, the monitor module outputs a signal to the frequency pin to reduce the switching frequency of the power module, wherein a photoresistor is connected in series between the frequency pin and a ground terminal of the backlight driving circuit; the photoresistor is arranged on a position directly irradiated by the LED lightbar.

10. The LCD device of claim 9, wherein the monitor module comprises a comparator and a first controllable switch; a first resistor and a second resistor are connected in series between the frequency pin and a ground terminal of the backlight driving circuit; the first controllable switch and the second resistor are connected in parallel; a comparison voltage is inputted to an inverting input of the comparator, and a non-inverting input of the comparator is coupled with a divider resistor and is connected with the detection module.

11. The LCD device of claim 9, wherein the detection module comprises a divider resistor and a photoresistor that is adjacent to the LED lightbar; a high level reference voltage is inputted to an end of the photoresistor; an opposite end of the photoresistor is coupled with a ground terminal of the backlight driving circuit through the divider resistor; a voltage across the divider resistor is fed back to the monitor module.

12. The LCD device of claim 11, wherein the monitor module comprises a comparator and a first controllable switch; a first resistor and a second resistor are connected in series between the frequency pin and the ground terminal of the backlight driving circuit; the first controllable switch and the second resistor are connected in parallel; a comparison voltage is sent to an inverting input of the comparator, and a non-inverting input of the comparator is coupled with a divider resistor and is connected with the detection module.

13. The LCD device of claim 9, wherein the detection module comprises a filtering resistor and a filtering capacitor, the monitor module comprises a comparator and a first controllable switch; a first resistor and a second resistor are connected in series between the frequency pin and a ground terminal of the backlight driving circuit; the controllable switch and the second resistor are connected in parallel;

wherein a comparison voltage is inputted to an inverting input of the comparator, and the PWM dimming signal is sent to the non-inverting input of the comparator through the filtering resistor the filtering capacitor is connected in series between the non-inverting input of the comparator and the ground terminal of the backlight driving circuit.

14. The LCD device of claim 9, wherein the power module comprises an inductor, a diode, an adjusting voltage controllable switch, and a capacitor; an external input voltage is sent to an end of the inductor; an opposite end of the inductor is coupled with an anode of the diode, and is coupled with a ground terminal of the backlight driving circuit through the adjusting voltage controllable switch; a cathode of the diode is coupled with an anode of the LED lightbar, and is coupled with the ground terminal of the backlight driving circuit through the capacitor; the adjusting voltage controllable switch is coupled with the control module.

15. The LCD device of claim 9, wherein the adjusting module comprises an adjusting dimming controllable switch; an input end of the adjusting dimming controllable switch is coupled with a cathode of the LED lightbar; an output end of the adjusting dimming controllable switch is coupled with a ground terminal of the backlight driving circuit through a current-limiting resistor; the PWM dimming signal is sent to a control end of the controllable switch.

16. The LCD device of claim 9, wherein the power module comprises an inductor, a diode, an adjusting voltage controllable switch, and a capacitor; an external input voltage is sent to an end of the inductor; an opposite end of the inductor is coupled with an anode of the diode, and is coupled with a ground terminal of the backlight driving circuit through the adjusting voltage controllable switch; a cathode of the diode is coupled with an anode of the LED lightbar, and is coupled with the ground terminal of the backlight driving circuit through the capacitor; the adjusting voltage controllable switch is coupled with the control module;

wherein the adjusting module comprises an adjusting dimming controllable switch; an input end of the adjusting dimming controllable switch is coupled with a cathode of the LED lightbars; an output end of the adjusting dimming controllable switch is coupled with a ground terminal of the backlight driving circuit through a current-limiting resistor; the PWM dimming signal is sent to a control end of the controllable switch;

wherein the detection module comprises a divider resistor and a photoresistor that is adjacent to the LED lightbar; a high level reference voltage is inputted to an end of the photoresistor; an opposite end of the photoresistor is coupled with the ground terminal of the backlight driving circuit through the divider resistor;

wherein the monitor module comprises a comparator and a first controllable switch; a first resistor and a second resistor are connected in series between the frequency pin and the ground terminal of the backlight driving circuit; the first controllable switch and the second resistor are connected in parallel; a comparison voltage is inputted to an inverting input of the comparator, and a non-inverting input of the comparator is coupled with an end of a divider resistor that is connected with the photoresistor.

17. A method for driving a backlight driving circuit, the backlight driving circuit comprising a power module controlled by switching frequency, a light emitting diode (LED) lightbar coupled with the power module, and an adjusting module that adjusts a duty cycle of an effective current flowing through the LED lightbars; an external pulse-width modulation (PWM) dimming signal being sent to the adjusting module; the method comprising:

A: setting a preset threshold of the duty cycle of the PWM dimming signal; and

B: monitoring the duty cycle of the PWM dimming signal in real time, wherein if the duty cycle of the PWM dimming signal is less than the preset threshold, the switching frequency of the power module is reduced; if the duty cycle of the PWM dimming signal is greater than the preset threshold, the switching frequency of the power module is not changed.

* * * * *